US005678757A

United States Patent [19]

Martin

[11] Patent Number: 5,678,757

[45] Date of Patent: Oct. 21, 1997

[54] MAILBOX UNIT

[76] Inventor: Harry W. Martin, 2027 George Rd., Palm, Pa. 18070-1018

[21] Appl. No.: 439,365

[22] Filed: May 11, 1995

[51] Int. Cl.[6] ..... B65D 91/00

[52] U.S. Cl. ..... 232/17; 232/39

[58] Field of Search ..... 232/39, 17; D99/29, D99/32, 33; 248/910

[56] References Cited

U.S. PATENT DOCUMENTS

| | | | |
|---|---|---|---|
| 1,504,514 | 8/1924 | Ryther | 232/17 |
| 1,662,171 | 3/1928 | Savery | 248/910 X |
| 1,704,248 | 3/1929 | Heilbrun | 248/910 X |
| 2,902,211 | 9/1959 | Franklin | 232/39 X |
| 2,963,168 | 12/1960 | Wilson | 232/39 X |
| 4,508,259 | 4/1985 | Hicks | 232/17 |
| 4,588,123 | 5/1986 | Plew | 232/39 |
| 5,029,783 | 7/1991 | Alvarez | 232/39 X |
| 5,337,954 | 8/1994 | Kobilarcik et al. | 232/39 X |
| 5,356,072 | 10/1994 | Thomas | 232/39 |
| 5,400,959 | 3/1995 | Cone | 232/39 |

FOREIGN PATENT DOCUMENTS

| | | | |
|---|---|---|---|
| 918835 | 2/1963 | United Kingdom | 248/910 |

OTHER PUBLICATIONS

Catalog from Barrons Gaithersburg, Lumber, "How to Build a Mailbox Stand and Planter", Apr. 1989.

*Primary Examiner*—Kenneth J. Dorner
*Assistant Examiner*—Jerry Redman
*Attorney, Agent, or Firm*—Joseph W. Molasky & Associates

[57] ABSTRACT

A mailbox unit comprising a hollow housing member mounted on a support member affixed to a base. Hinges are connected to the housing member and support member for allowing the mailbox to tilt upon being struck by a damaging lateral force. The base has a bottom that comprises a beveled outer portion that converges downward defining a generally conical shape with a flat center portion which permits the mailbox unit to rock after being subjected to a damaging lateral force.

12 Claims, 9 Drawing Sheets

FIG. 1
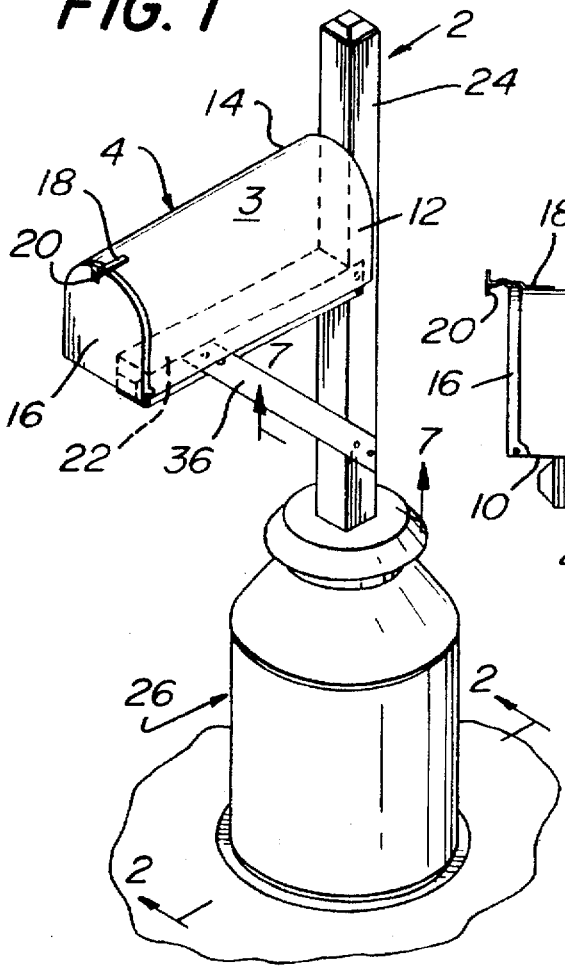
FIG. 2
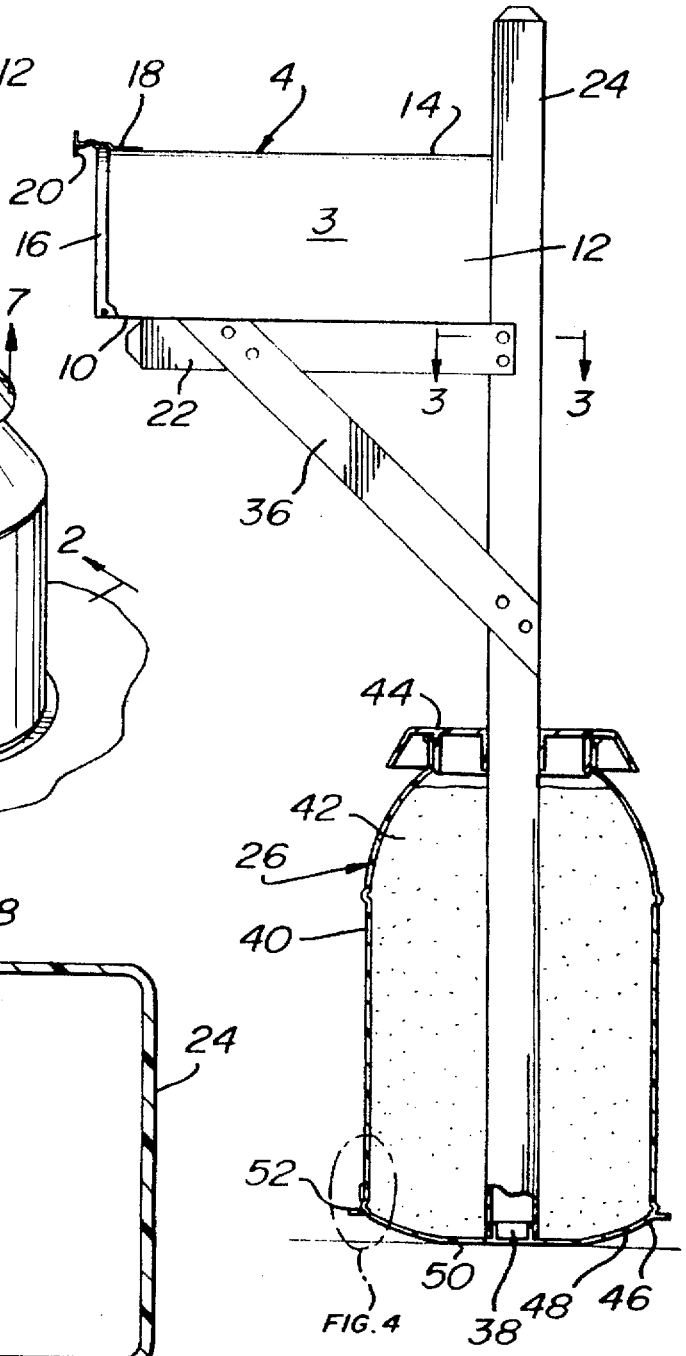
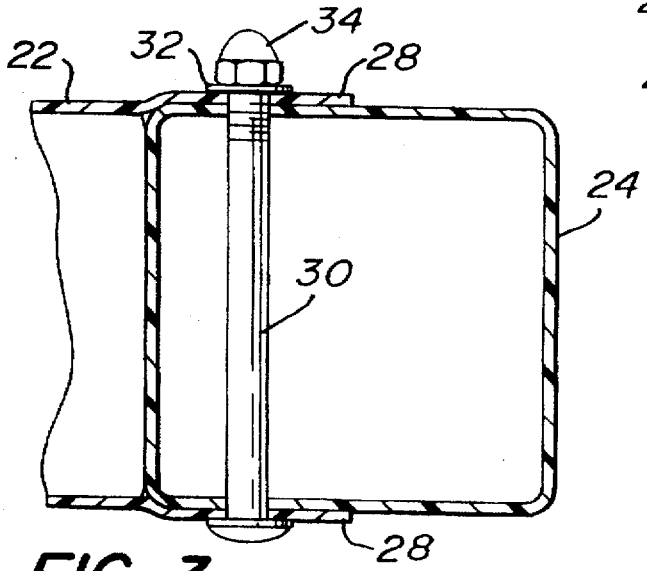
FIG. 3

4
4
4
4
4
4
82
3
3
3
3
3
3
84
12
82
84
44
26
40

24
4
4
4
4
4
4
3
3
3
3
3
3
82
82
84
84
44

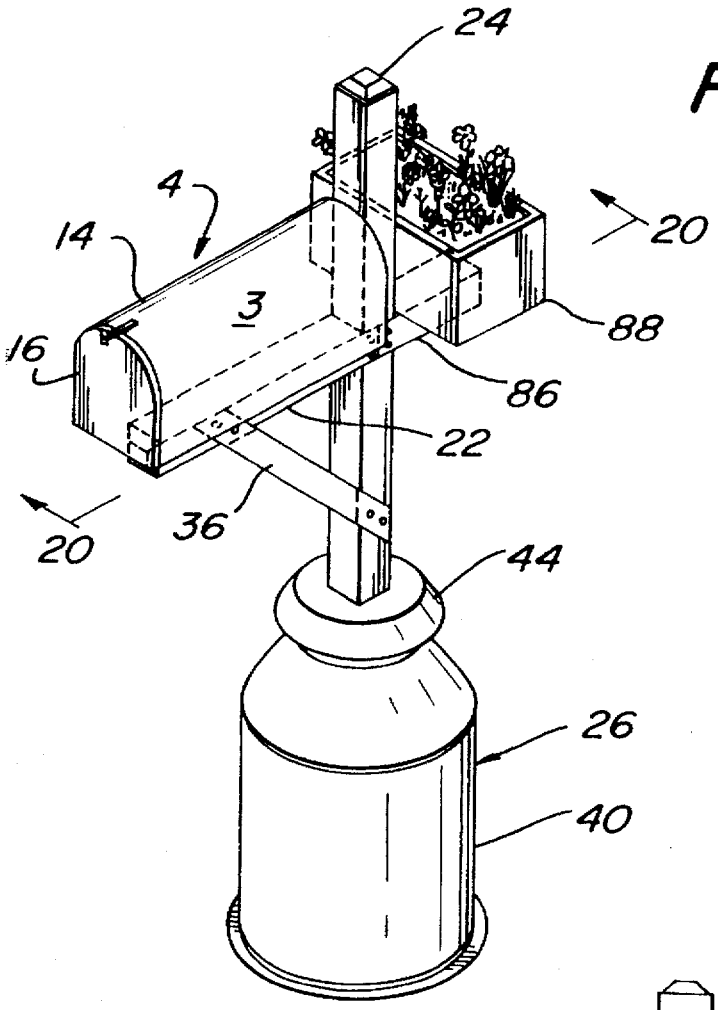
FIG. 19
FIG. 20
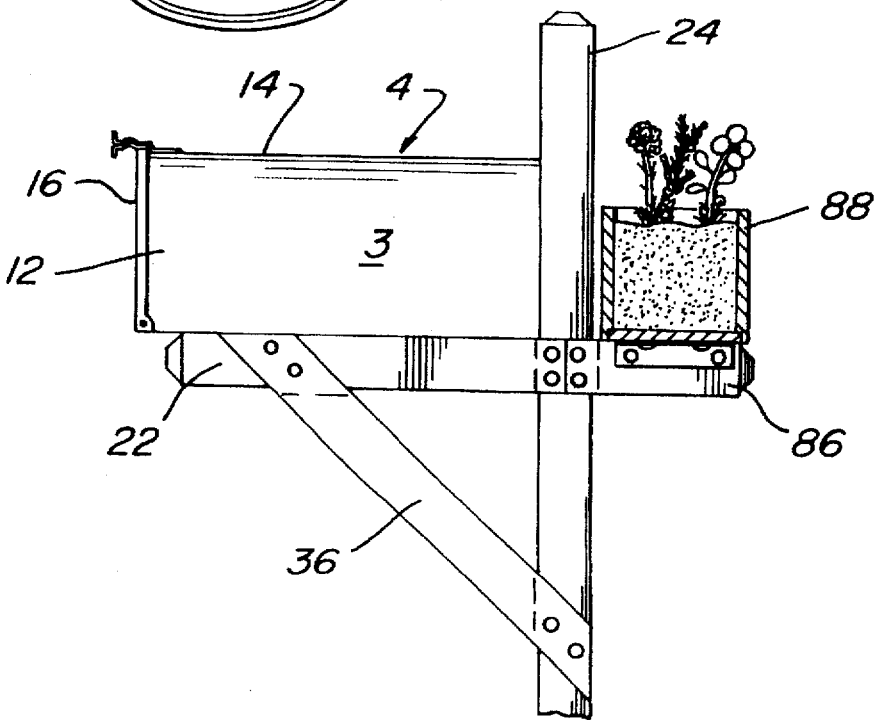

FIG. 21
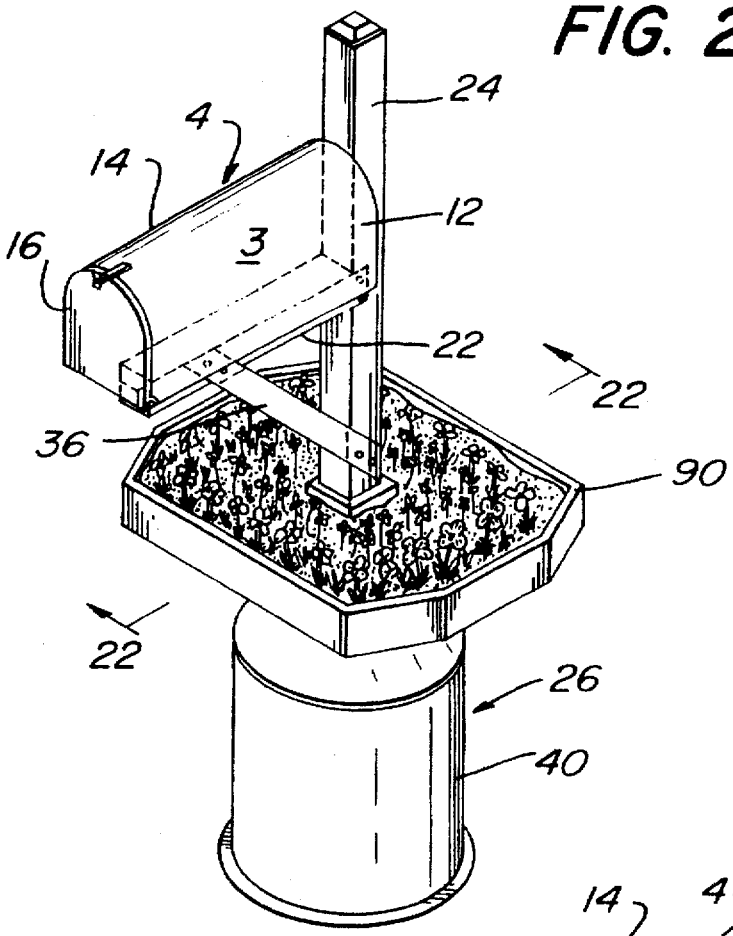
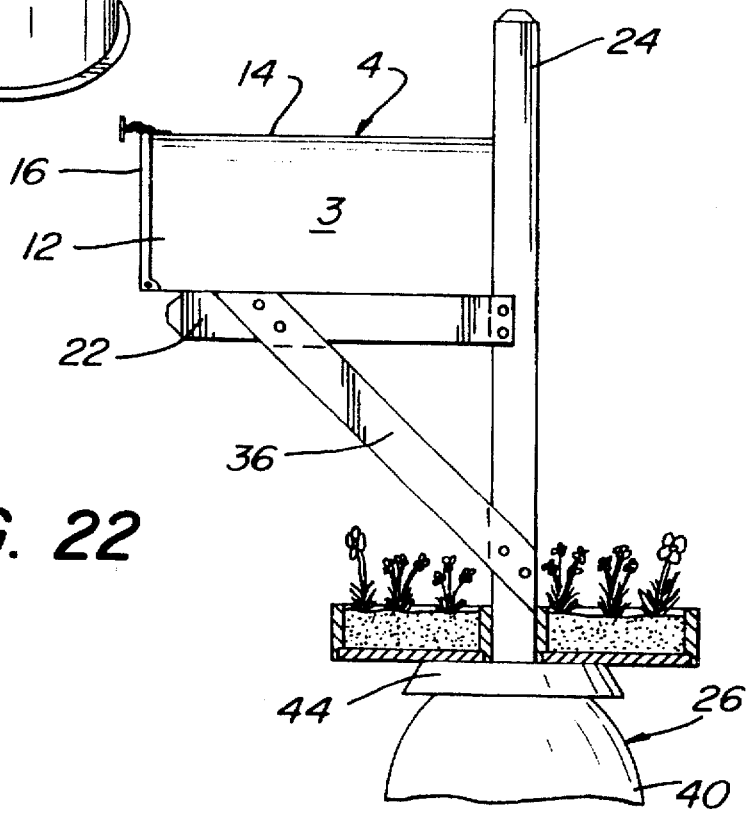
FIG. 22

MAILBOX UNIT

BACKGROUND OF THE INVENTION

This invention is related to mailbox units. Most mailboxes, especially in rural and suburban areas, are usually affixed above the ground on a vertical post positioned adjacent a road. Frequently, the road is heavily traveled by pedestrians and vehicles with the vehicles passing at moderate to high speeds a relatively few feet from the mailbox unit. Because of this situation, the mailbox units are frequently knocked off or broken by damaging lateral forces arising from the traffic such as a snow plow or chain swung by vandals. Often these damaged mailbox units can be difficult and costly to repair or replace, which may even require digging another hole in the ground to mount the mailbox unit.

SUMMARY OF THE INVENTION

This invention is directed to solving this problem by employing a pivot means that allows the mailbox to tilt from side to side about a horizontal axis after being struck by an external force. Also, the base is constructed to rock back and forth to absorb the force.

Hence, it is an object of this invention to provide a mailbox unit that maintains its integrity after being struck by a damaging lateral force.

It is another object of this invention to provide a mailbox unit which is easy to assemble.

This invention achieves these objects by providing a mailbox unit comprising a hollow housing having a bottom, top, and side portions and a support means connected to a base for holding the housing member in a position above the ground. The mailbox unit includes pivot means connected to the housing member and support means for allowing the mailbox to tilt from side-to-side upon being struck by a damaging force. Catches are attached to the mailbox and support means for preventing the mailbox from tilting due to small lateral forces applied to the side of the mailbox that are of a small magnitude that would not damage said mailbox.

To further maintain the integrity of the mailbox unit, the mailbox unit further includes movement means integrally formed on the bottom of the base for permitting the mailbox unit to rock after being struck by a damaging lateral force. In particular, the movement means comprises a beveled outer portion at the bottom of the base that converges downwardly defining a generally conical shape with a flat center portion. The base also includes limiting means that limit the rocking distance of the base.

These and other aspects of the invention will be better understood by making references to the drawings.

BRIEF DESCRIPTION OF THE DRAWINGS

FIG. 1 is a perspective view of the invention.

FIG. 2 is a sectional view of the invention taken along line 2—2.

FIG. 3 is a sectional view of the invention of FIG. 2 taken along line 3—3.

FIG. 19 is a perspective view of another embodiment of the invention.

FIG. 20 is a sectional view of the invention of FIG. 19 taken along line 20—20.

FIG. 21 is a perspective view of another embodiment of the invention.

FIG. 22 is a sectional view of the invention of FIG. 21 taken along line 22—22.

DETAILED DESCRIPTION OF THE INVENTION

Figure 4:
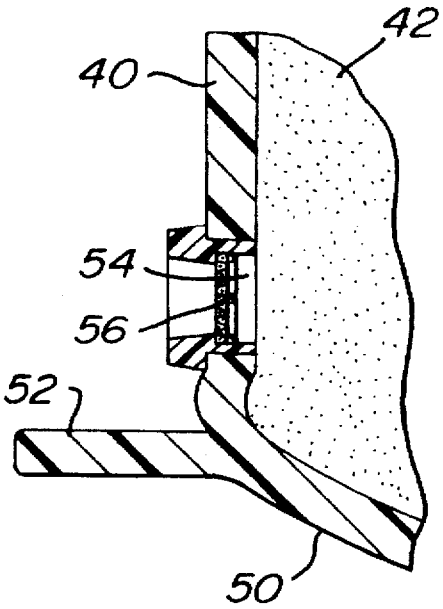
FIG. 4 is an enlarged view of a portion of FIG. 2.

The present invention includes several embodiments with identical elements given the same reference numerals. The present invention includes a mailbox unit 2 as illustrated in FIGS. 1 and 2. The mailbox unit 2 generally comprises a mailbox 3 having a longitudinally extending housing member 4 formed of a rear wall 8 (FIG. 7), flat floor 10 and opposite vertical side walls 12 (FIG. 8) integrally formed with a curved top 17.

A door 16 is pivotally mounted on its lower portion to the front end of the housing 4. A door latch 18 is shown, being of the type used to lock the door 16 into the closed position by partially covering the handle 20 on the door. In order to open the door 16, the user pulls on the door handle 20 with sufficient force to overcome the spring locking action of the door latch 18. This feature is a typical arrangement for such mailbox doors, however, it should be noted that other structural arrangements for the door 16, handle 20, and latch 18 may be used.

The mailbox 3 is mounted on an arm 22 extending horizontally from a vertical post 24 mounted to a base 26 as shown in FIG. 1. As depicted in FIG. 3, the post 24 and arm 22 are generally hollow having a rectangular shape and composed of metal, plastic, or other suitable material. The arm 22 includes a pair of rearwardly projecting extensions 28, each integrally form with the arm 22 at its rear end for aid in affixing the arm 22 to the post 24. Specifically, the vertical post 24 is inserted between the extensions 28 and secured therein by a transverse bolt 30 extending through the post 24 and extensions 28 with the bolt 30 being locked by a lock washer 32 and nut 34.

A diagonal support member 36 is also attached by an identical nut and bolt assembly between the bottom surface of the arm member 22 and at a location on the vertical post 24 below the arm member 22. The post 24 is anchored into a base 26. Specifically, the post 24 is fitted over a square peg 38 which extends upwardly from the bottom 46 of the base 26 and into the hollow interior of the post 24 securing the post 24 thereon as shown in FIG. 2.

The base 26 comprises a container 40 which is preferably a milk can compose of a plastic or a hard rubber material. It should be noted that other containers can be used as well. After the post 24 is mounted to the base 26, the container 40 is filled with sand 42. A hard rubber seal 44 is then slipped over the top of the post 24 and down onto the top of the container 40 to both keep the sand 42 from spilling out and the post 24 centered.

Figure 5:
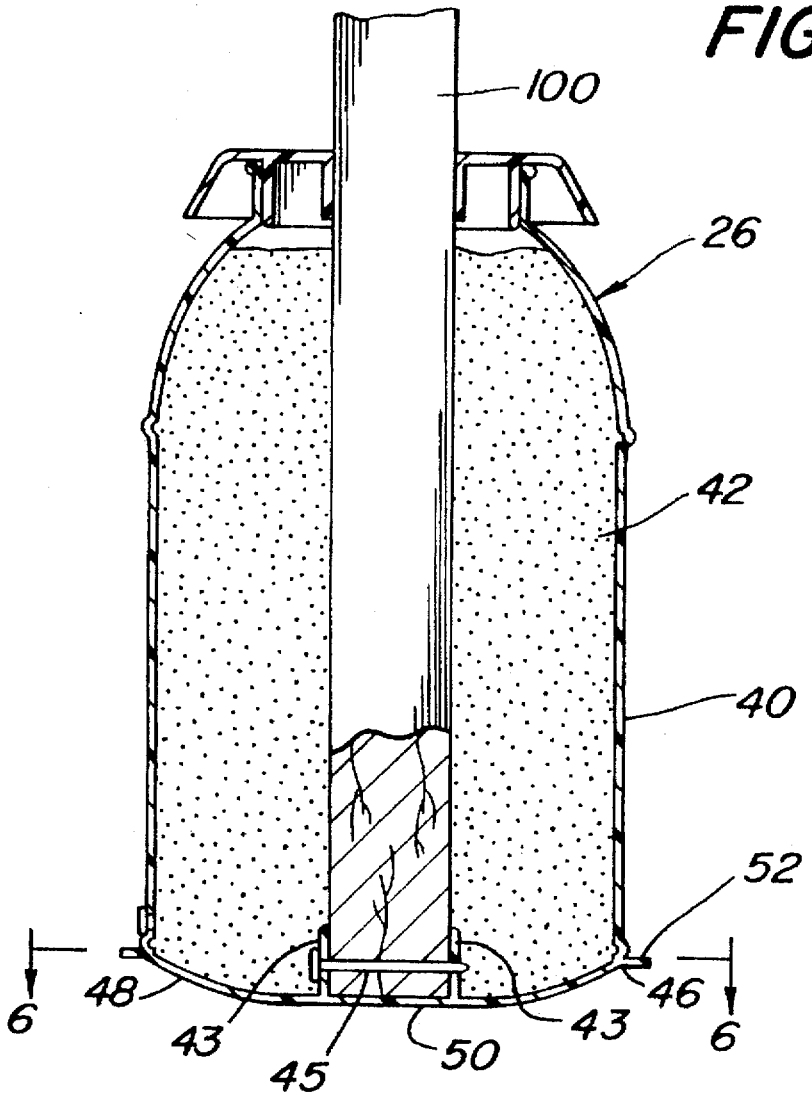
FIG. 5 is a sectional view of mailbox base of another embodiment of the invention.
Figure 6:
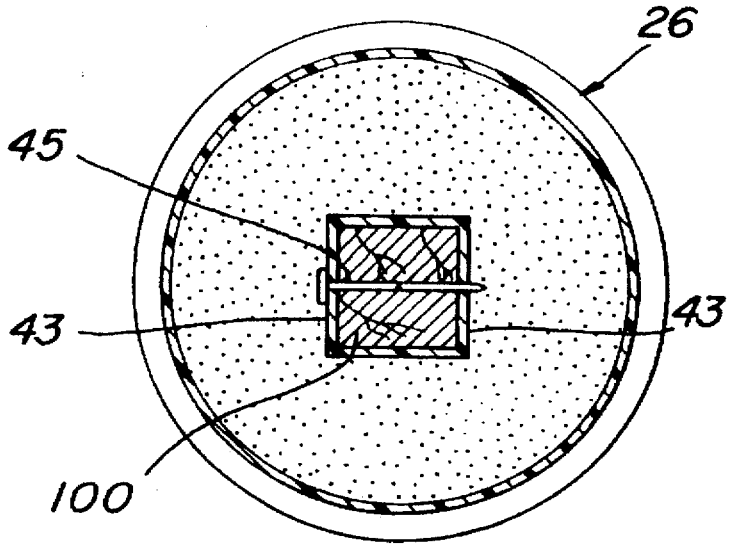
FIG. 6 is a sectional view of the invention of FIG. 5 taken along line 6—6.
Figure 9:
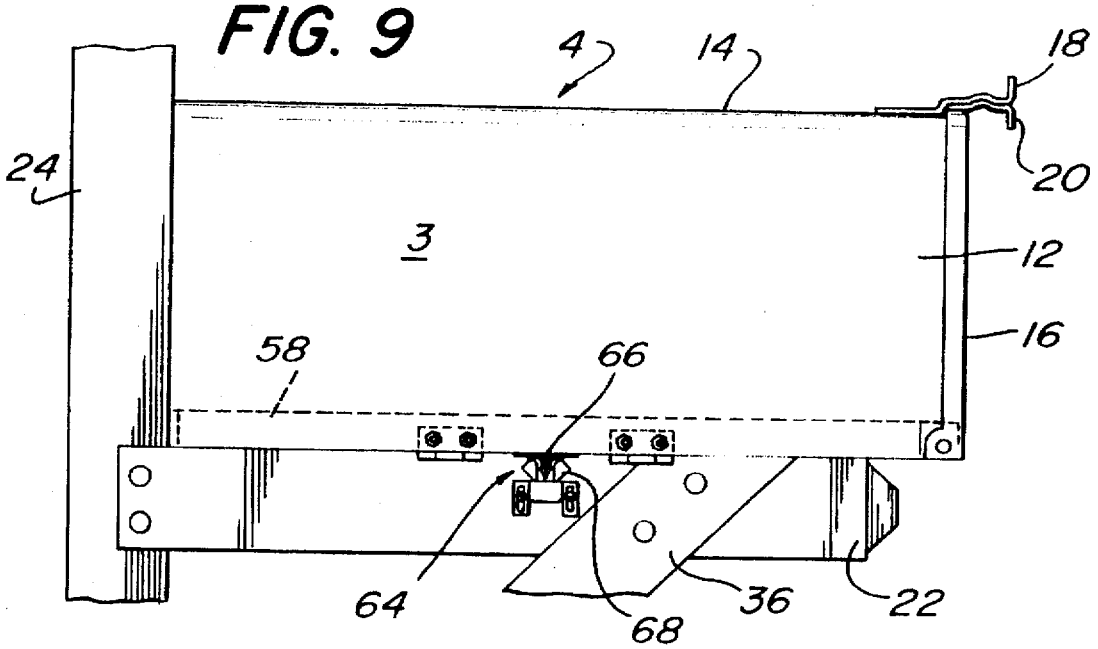
FIG. 9 is a fragmentary side view of another embodiment of the invention.
Figure 10:
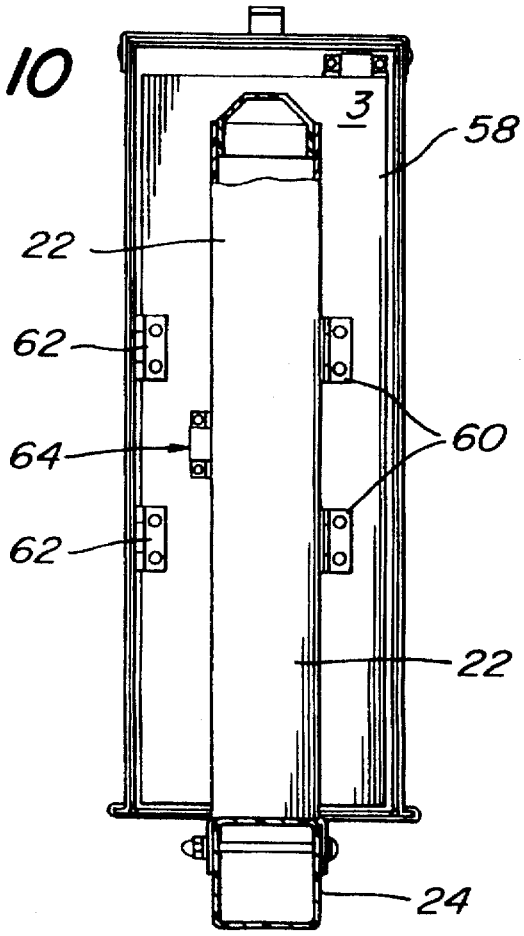
FIG. 10 is bottom view of the invention of FIG. 9.

As seen in FIG. 2, the base 26 has a bottom 46 which has a beveled outer portion 48 that converges downward defining a generally conical shape with a flat center portion 50. This feature permits the mailbox unit 2 to withstand damaging lateral forces by allowing the mailbox unit to rock rather than break. The outer portion 48 terminates into an outer flange 52 that checks or limits the tilting distance of the base 26 after being struck and, thus, preventing the mailbox unit 2 from falling over. As shown in FIG. 4, the container 40 includes a drain 54 covered by a removable plug 56 disposed above the flange 52 to drain out excess water entering into the container 40. The post 100 can also be removably connected to the base 26 as depicted in FIGS. 5 and 6. In this embodiment, the base 26 has a pair of opposite plates 43 extending upwardly from the bottom 46 of the base 26 to receive the post 100. A cotter pin 45 is inserted through bores in the plates 43 and post 100 locking the post 100 therein.

Figure 7:
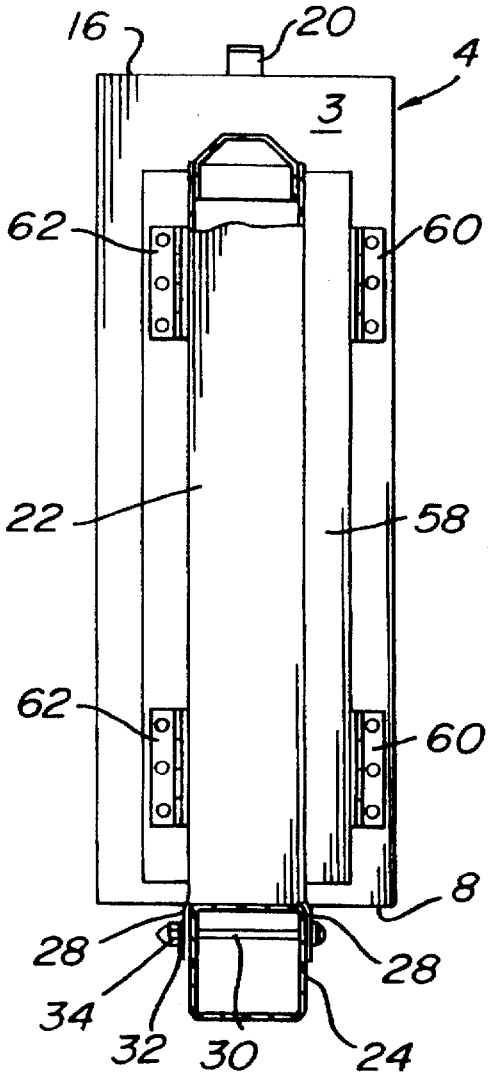
FIG. 7 is a sectional view of the invention of FIG. 1 taken along line 7—7.
Figure 8:
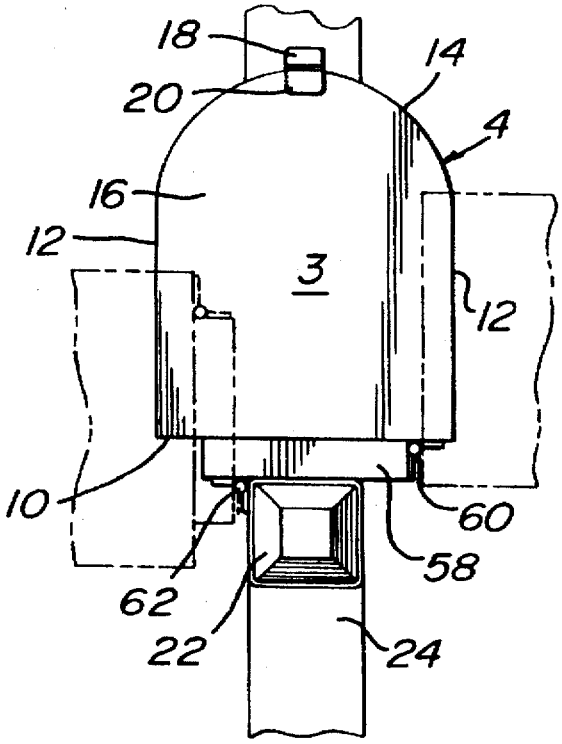
FIG. 8 is a fragmentary front elevational view of the invention.

Referring to FIGS. 7 and 8, the mailbox 3 is pivotally mounted on a platform 58 and the arm member 22 by hinges 60 and 62 fastened thereon. In particular, a pair of hinges 60, located on the right side of the mailbox 3, are fastened to the bottom of the mailbox 3 and platform 58 and a pair of hinges 62, located on the left side of the mailbox, are fastened to the bottom of the platform 58 and arm member 22. This arrangement allows the mailbox 3 to tilt on each side.

Specifically, as depicted in FIG. 8, when the mailbox 3 tilts to the right, the platform 58 remains stationary and the left side of the mailbox 3 is free to rotate since it is not secured to the platform 58. When the mailbox 3 tilts to the left, the platform 58 and right side of the mailbox 3 are free to rotate since they are not secured to the horizontal arm member 22.

Figure 11:
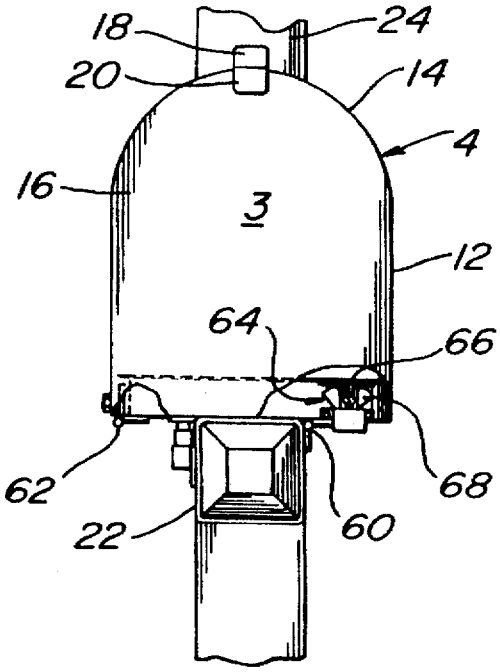
FIG. 11 is a front view of the invention shown in FIG. 7 with portions cut away.

Referring to FIGS. 9–14, catches 64 are secured to the platform 58 and arm member 22 to prevent the mailbox 3 from tilting due to lateral forces applied to the side of the mailbox 3 that are of a small magnitude that would not damage the mailbox 3. In one embodiment depicted in FIGS. 9 and 10, the catch 64 comprises a downwardly depending tongue 66 mounted on a side of the floor 10 of the mailbox 3 and a pair of resilient rollers 68 affixed to the arm 22 and aligned directly under the tongue 66. In its stationary position, the tongue 66 is inserted between the rollers 68 which lock the mailbox 3 in place. If the side of the mailbox 3 is struck by a force of sufficient magnitude to damage the mailbox 3, the rollers 68 will flex apart to release the tongue 66 and allow the mailbox 3 to tilt instead of breaking. As shown in FIG. 11, the tongue 64 can also be mounted to the front of the floor 10 with the rollers affixed to the front of the platform 58 directly under the tongue 66.

Figure 12:
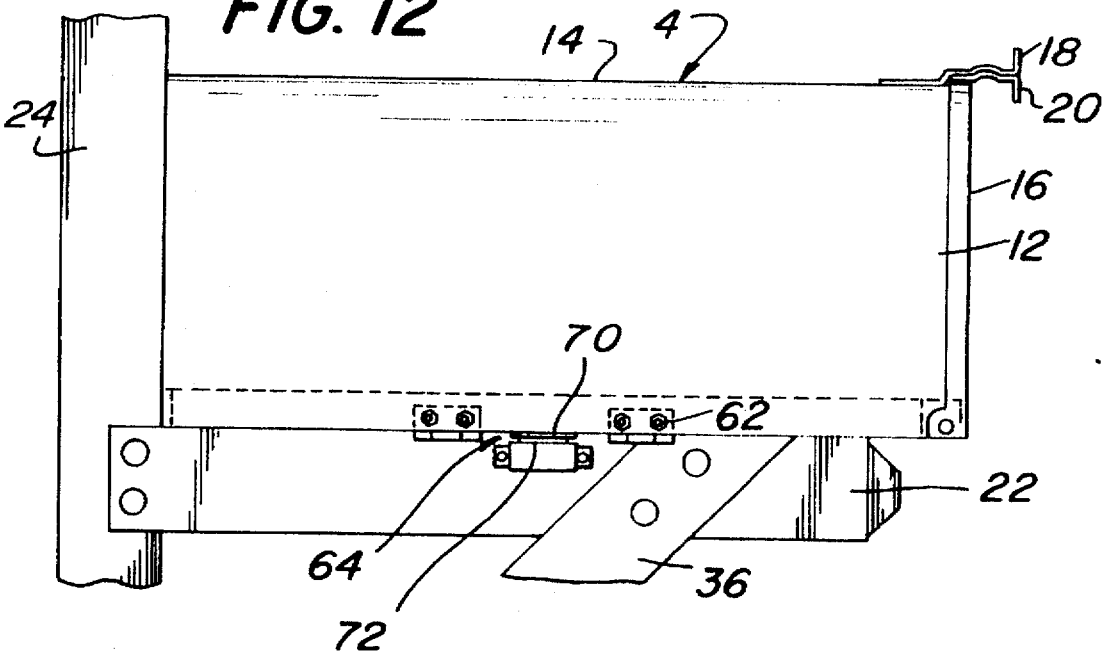
FIG. 12 is a fragmentary side view of another embodiment of the invention.
Figure 13:
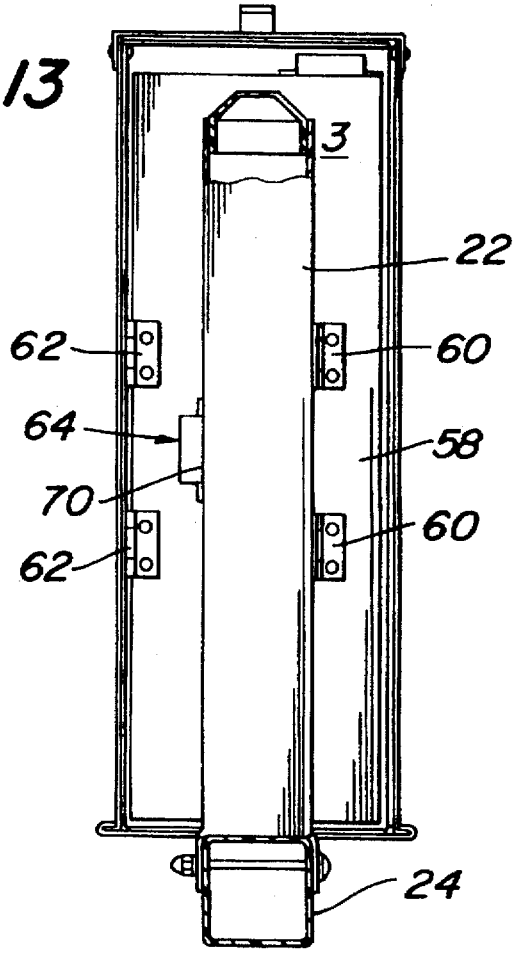
FIG. 13 is a bottom view of the invention shown in FIG. 12.
Figure 14:
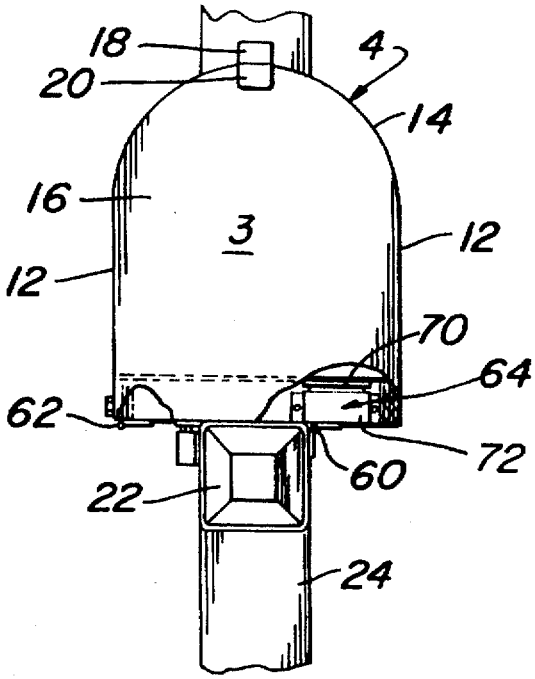
FIG. 14 is a front view of the invention shown in FIG. 12.

In another embodiment as shown in FIGS. 12 and 13, the catch 64 comprises a pair of opposing magnets 70 and 72, one secured to a side of the floor 10 of the mailbox 3 and the other secured to the arm 22. Alternatively, one magnet 70 can be secured to the front of the floor 10 with the other magnet 72 secured to the front of the platform 58 as shown in FIG. 14. The magnets 70 and 72 have an attraction force that holds the mailbox but also allows it to tilt, if the side of the mailbox is struck by a lateral force of a sufficient magnitude to damage it.

Figure 15:
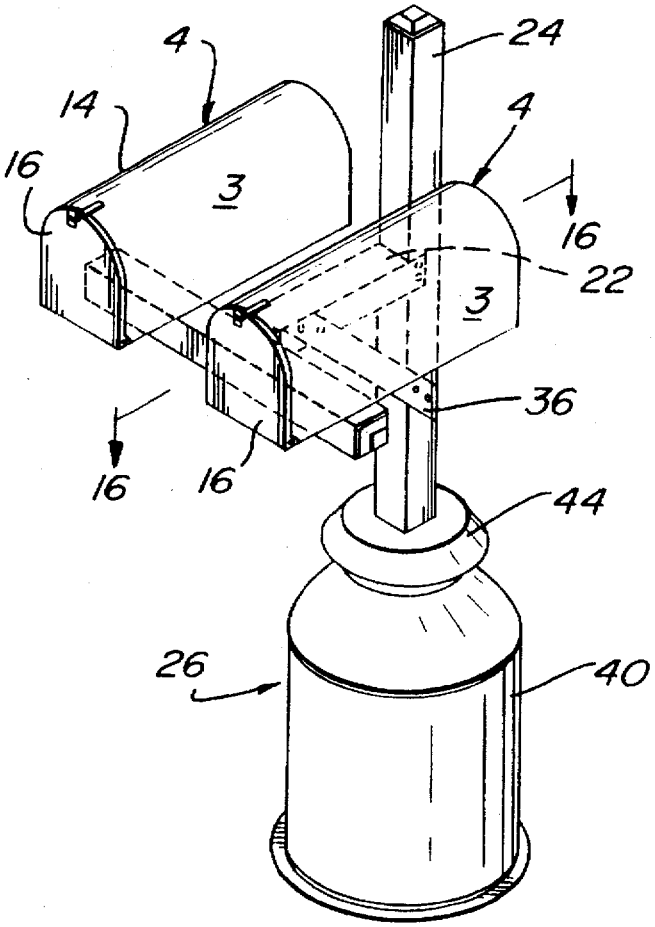
FIG. 15 is a perspective view of another embodiment of the invention.
Figure 16:
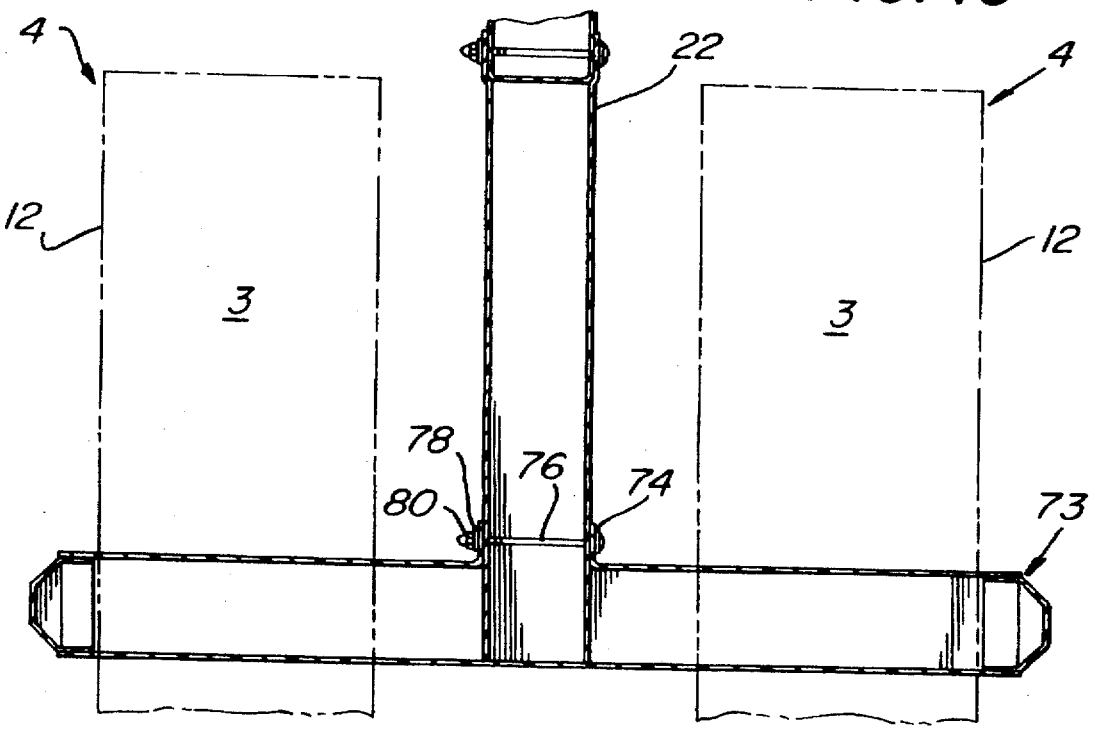
FIG. 16 is a sectional view of the invention of FIG. 15 taken along line 16—16.

In another embodiment as shown in FIG. 15, the horizontal arm member 22 includes a T-shaped extension 73 that supports two mailboxes 3. As seen in FIG. 16, the extension 73 has a hollow center neck 74 that terminates into an open end. The arm member 22 is partially inserted into the center neck 74 and secured therein by a transverse bolt 76 extending through the neck 74 and arm 22 with the bolt 76 being locked by a lock washer 78 and nut 80.

Figure 17:
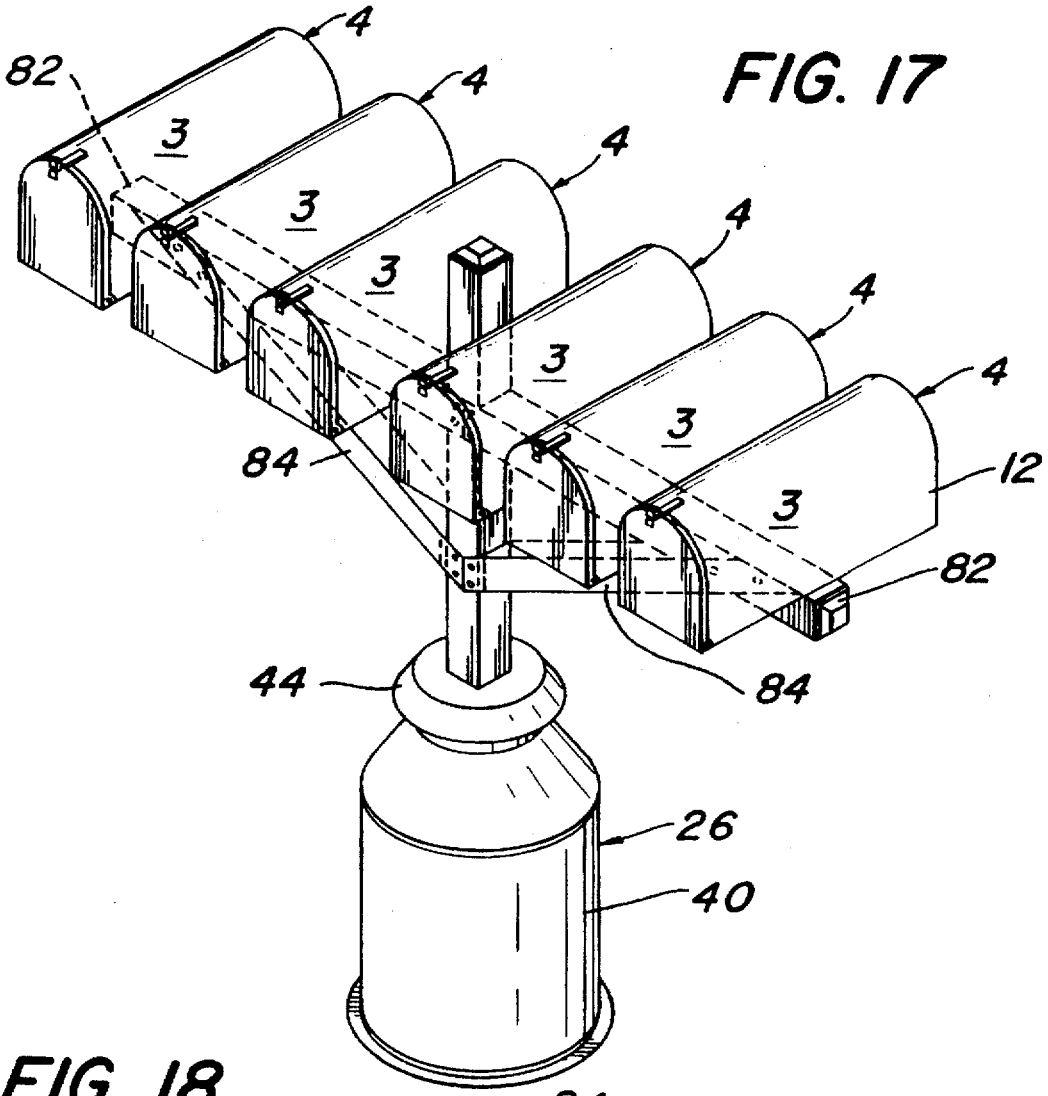
FIG. 17 is a perspective view of another embodiment of the invention.
Figure 18:
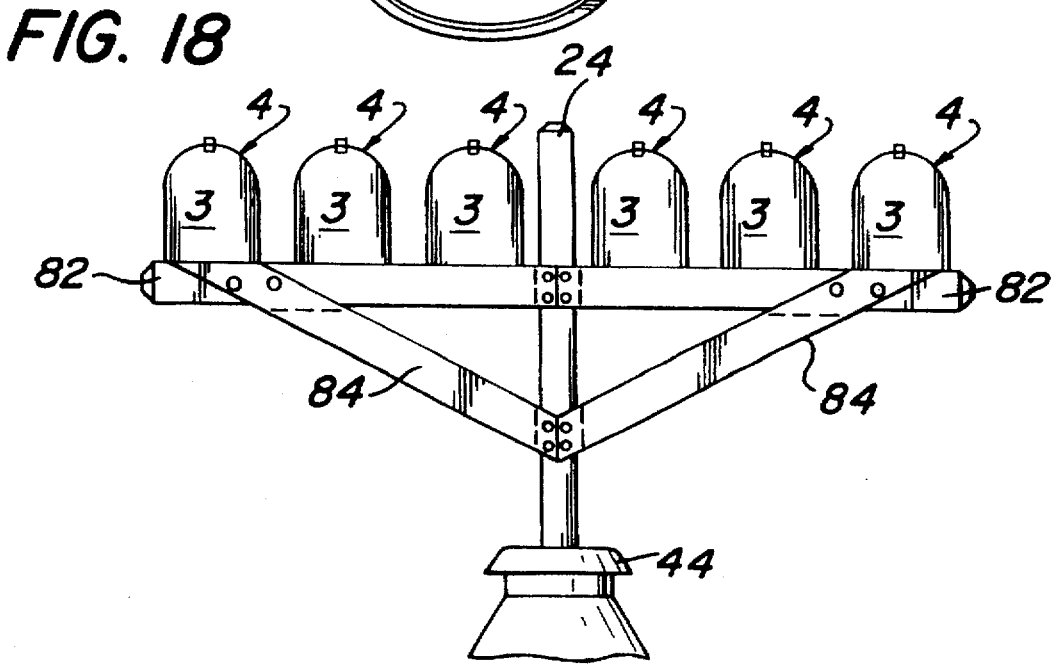
FIG. 18 is a front view of the invention shown in FIG. 17.

FIGS. 17 and 18 depict yet another embodiment of the invention. In this embodiment, the vertical post 24 has a pair of opposite horizontal support arms 82 that support multiple mailboxes 3 that are positioned in a side-by-side relationship along the length of each arm 82. Each arm 82 is supported by a diagonal support member 84 identical to the one shown in FIG. 1.

Further embodiments are shown in FIGS. 19, 20, 21, and 22. In the embodiment shown in FIGS. 19 and 20, the vertical post 24 has a short horizontal support arm 86 that supports a flower bed 88. The embodiment shown in FIGS. 21 and 22 depict another flower bed 90 supported by the seal member 44.

This invention has been described by reference to precise embodiments, but it will be appreciated by those skilled in the art that this invention is subject to various modifications and to the extent that those modifications would be obvious to one of ordinary skill they are considered as being within the scope of the appended claims.

What is claimed:

1. A mailbox unit comprising:

a.) a mailbox having a hollow housing member defining a bottom, top, and side portions including catch means attached to said housing member and support means for preventing said housing member from tilting when impacted by lateral forces which are of a small magnitude such as would not damage said housing member;

b.) support means connected to a base for holding said housing member in a position above the ground including a generally vertical support post and a generally horizontal support am attached to said vertical support post, said vertical support post being anchored to said base, said housing member being mounted upon said horizontal arm, said base including a beveled outer portion that converges downward to define a generally conical segment having a flat center portion;

c.) pivot means connected to said housing member and to a platform member joined to said horizontal arm for allowing said housing member to tilt from side-to-side upon being struck by a lateral force.

2. The mailbox unit of claim 1 wherein said pivot means comprises a first and second set of hinges, said first set being fastened to said platform and to the bottom side of said housing member in close proximity to one longitudinal edge thereof, and said second set being fastened to said platform and said horizontal arm in proximity to the opposite edge of said housing member.

3. The mailbox unit of claim 1 including limiting means that limit the rocking distance of the base.

4. The mailbox unit of claim 3 wherein said limit means is an outwardly extending flange disposed around the base.

5. The mailbox unit of claim 1 wherein said base is a second hollow housing member filled with granular particles.

6. The mailbox unit of claim 5 including a seal member attached to the top of the container.

7. The mailbox unit of claim 5 including a seal member covering the top of said base to prevent the granular particles from spilling over.

8. The mailbox unit of claim 1 including a second horizontal support member attached to said vertical post for supporting a flower bed.

9. The mailbox unit of claim 1 including locking means for removably connecting said post to said base.

10. The mailbox unit of claim 9 wherein said locking means is comprised of a pin extending through a pair of opposite plates and said post positioned between said plates.

11. The mailbox unit of claim 1 including a generally horizontal support member attached to said top of said base for supporting a flower bed.

12. The mailbox unit of claim 1 wherein said vertical post is fitted over a protrusion extending upwardly from said bottom of said base.

* * * * *